United States Patent [19]

Dick et al.

[11] Patent Number: 4,557,757

[45] Date of Patent: Dec. 10, 1985

[54] METAL REFINING PROCESS

[75] Inventors: Thomas R. Dick, Hamilton; James F. Metcalf, Motherwell, both of Scotland

[73] Assignee: Consarc Engineering Ltd., Scotland

[21] Appl. No.: 613,055

[22] Filed: May 22, 1984

[30] Foreign Application Priority Data

May 24, 1983 [GB] United Kingdom ..... 8314298

[51] Int. Cl.[4] ..... C21C 5/34; C21C 7/10

[52] U.S. Cl. ..... 75/49; 266/208

[58] Field of Search ..... 75/49, 60, 59; 266/208

[56] References Cited

U.S. PATENT DOCUMENTS 3,240,588 3/1966 Finkl ..... 266/208

4,154,603 5/1979 Oguchi ..... 75/49

4,174,212 11/1979 Bauer ..... 75/49

*Primary Examiner*—Peter D. Rosenberg

*Attorney, Agent, or Firm*—Leydig, Voit & Mayer, Ltd.

[57] ABSTRACT

The present invention provides a process for the refining of metal by the removal of unwanted constituents 11 therefrom. The process comprises melting down the metal 8 under an atmosphere in which the ratio of the partial pressure of non-deleterious gas 6 to the partial pressure of deleterious gas 10 is at least 10:1. The invention also provides an apparatus comprising a vacuum induction melting furnace 3, a vessel 2 for holding metal 8 and gas exhaustion means 4 for extraction of gas from the furnace 3. A gas supply means 6 is formed and arranged 5 for directing a flow of gas substantially directly at the mouth of said vessel 2.

6 Claims, 1 Drawing Figure

METAL REFINING PROCESS

Figure 1:
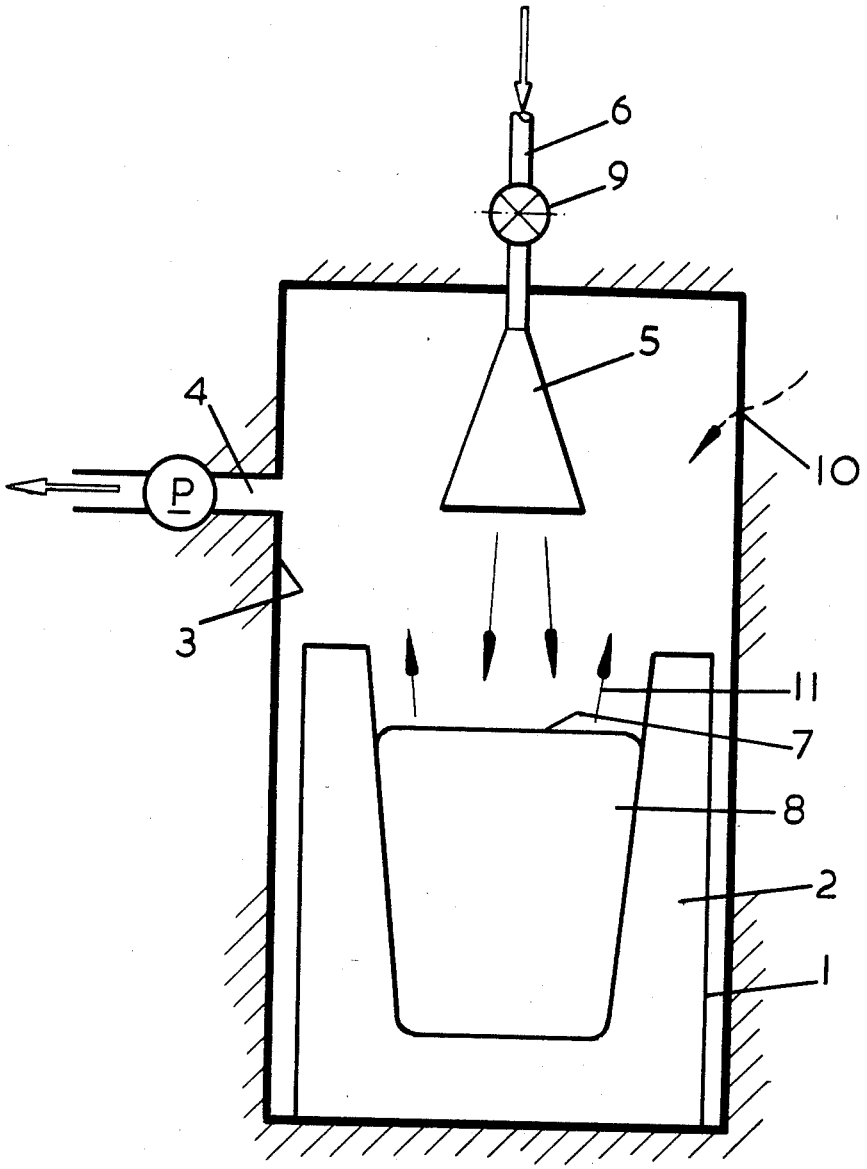

This invention relates to an improved process of metal refining and particularly to an improved process for de-oxidising metal and removing unwanted constituents.

A main use of the process is in the refining of metal alloys of iron, nickel and cobalt base in a vacuum melting furnace. The most widely used process at present for refining alloys consists of melting down and processing the alloys in the lowest sub-atmospheric pressure which can be obtained in the furnace chamber with vacuum pumps which are in communication with the furnace chamber. The start of this process is heating of cold metal prior to melting in a condition in which the main part of the remaining atmosphere in the chamber is water vapour and air inleakage to the chamber.

The oxygen in this atmosphere is gettered to the surface to form metallic oxides. At the start of the melting process the oxidised metal is near its meltpoint in the bottom of the crucible containing the metal to be refined and when it reacts with carbon this reaction of cold metal causes splashes forming a scull around and on the wall of the crucible which stick to the refractory wall of the crucible as mixtures of metal and metal oxides. When the main bridge of metal falls into the pool as melting proceeds the metal is cooled with the liquid level being raised above the area of the frozen scull of metal and metal oxides. This scull does not react with carbon until all the metal is raised to a high temperature. Indeed some of this scull remains until aluminium and titanium are added. The resultant reduction by reactive metals causes slag in the melt.

Sub-atmospheric pressures above the pool in the known process vary between 0.0001 torr and 0.1 torr with 0.1 torr being considered by most metallurgists as the maximum level for vacuum melting. The sub-atmospheric pressure must be maintained against various actions which tend to destroy the sub-atmospheric pressure and particularly to increase the partial pressure of oxygen above the bath. These actions are:

(1) an inleakage of air. (Most modern equipment in practice do not have major inleakage), (2) addition of water vapour and absorbed air and oil vapours along with charge material being introduced into the vacuum furnace, (3) water leaks from internal cooled components, (4) internal water vapour exuded by the refractories and by dirt in the furnace. Water absorbed in this dirt forms ice because the dirt does not contain enough sensible heat to vaporise the water before the freezing point of water is reached. This ice in the dark region of the furnace is released slowly during the entire cycle of melting. After the melt down the high oxygen gases maintain a thin oxide layer on the surface of the metal and continually oxidise the metal of the pool. This blocks the surface reduction of nitrogen and hinders the boiling of low vapour pressure materials. Most processes require a long time or high temperature at this stage to allow absorbed water to be reacted or pumped away so that the required specification level of oxide in the metal and scull is reached.

Other sub-atmospheric pressures used in the known processes include the removal of carbon as CO by oxygen blowing on the metal with argon being bubbled through the pool. The pressure level of these processes vary from 1 to 10 torr with 1 torr being the lowest normal level for this process.

It is an object of the present invention to provide a process which improves largely on the known process of metal refining and results in a greatly improved purity and smaller content of unwanted materials such as metallic oxides and nitrides. This process can reach the desired result in a shorter time than can existing processes.

A process according to the invention comprises maintaining above the surface of a pool of hot solid and molten metal being treated, an atmosphere in which the ratio of the partial pressure of an introduced gas of characteristics necessary for the melting and refining process to the partial pressure of unwanted gases is at least 10:1.

The method of performing the process also according to the invention includes the steps of maintaining a pressure above the surface of the molten metal which is at most one torr and introducing and directing a chosen gas towards the hot or molten metal surfaces as an advancing mass which impinges against and covers the surface of the molten bath or hot metal.

The gas may be an inert gas such as argon or an oxidising gas such as oxygen or a reducing gas such as hydrogen or a corrosive gas such as chlorine or a reducing metallic vapour such as magnesium vapour.

The introduced gas may be a mixture of gases chosen from gases of the different types referred to above according to the state of refinement of the metal of the bath and the material being treated. Alternatively or additionally, selected gas, for example different gases chosen from the list referred to above may be used in succession at different stages of the process.

A practical embodiment of the invention is illustrated in the accompanying drawing in which 1 denotes a receptacle containing a refractory lining 2 for holding metal being refined. 3 denotes the confines of a furnace structure having an outlet 4 connected to a vacuum pump. 5 denotes a diverging nozzle connected to a supply pipe 6 for introducing gas to the nozzle 5, the nozzle 5 being so designed that the incoming gas is directed as an advancing means towards and diffused over the surface 7 of a bath 8 of molten metal contained in the receptacle 1. 9 denotes a control valve arranged to control the amount of gas entering the chamber 3. The arrows 10 denote gaseous material entering the chamber including incoming air from outside the furnace and water vapour exuding from the refractory lining and the arrows 11 denote vaporised material and reaction gases escaping from the surface of the bath 8.

In practice the gaseous contents of the chamber are extracted by the pump provided for the purpose through the passage 4 whereby to reduce the pressure in the chamber to a sub-atmospheric pressure. During the maintenance of a sub-atmospheric pressure gaseous material enters the chamber as indicated by the arrows 10. The leaks consist principally of leaks of air and water vapour. The inventors of the present invention have found that in fact the presence of water vapour has a far more serious effect on the efficiency of metal refining actions than has formerly been believed. In fact the water vapour can constitute a high proportion of the oxygen partial pressure.

In a normal vacuum induction melting furnace the action of the water vapour and of the inwardly leaking air tends to form a thin layer of oxide on the surface of the metal constituting the bath 8 and this layer persists even after the normal de-oxidation has taken place by the introduction of a de-oxidising alloy into the bath. The oxide layer introduces slag on to the surface of the bath which is mixed into the pool. Also a serious effect of the oxide layer is that it provides a barrier against nitrogen which has been combined in the molten metal and which would otherwise be able to escape as a result of the low pressure including a low partial pressure of $N_2$ maintained above the surface of the molten material in the absence of an oxide film. The atmosphere normally prevailing in the furnace chamber during a refining action comprises a mixture of leakage gases, $H_2O$ and vapour and the gas introduced to influence the refining action. The total pressure above the bath comprises the partial pressures of the gases, their reaction products, and the introduced gas. The applicants have found that by maintaining a ratio between the partial pressure of the leakage gaseous material and the partial pressure of the purposely introduced gas at a figure in the region of at least 1:10 the normal ill effects of the leakage gaseous material can be appreciably reduced. If this ratio is raised to say 1:100, 1:1000, 1:10,000 and depending on the gas selected the ill effects of leakage gases can be almost entirely eliminated or in certain cases the reaction reversed. These ratios can be achieved with a total pressure in the furnace chamber lying between 0.001 torr and 1 torr.

The desired ratio of these partial pressures according to the invention is not possible of attainment using the sub-atmospheric pressures normally known but is possible of achievement by reducing the leakage components to a figure lying in the range mentioned above which is far below that normally known. Introducing oxygen into a furnace chamber maintained at a low sub-atmospheric pressure has been heretofore regarded as being a disastrous proceeding in the refining of metals and leading to excessive oxidation. In fact the inventors of the present invention have found that it is possible to reduce the metal oxide floating on the surface by using a controlled flow of oxygen to start a carbon boil at the surface provided the incoming gas is so directed at the surface of the bath that it moves as a mass towards the surface with adequate force to depress the meniscus normally presented by the surface and spreads across the surface of the molten metal.

The whole concept of this invention although simple in its performance is revolutionary in conception. It shows the extremely good effect of destroying or preventing formation of the slag or oxide layer which would normally follow from the effects of leakage and water vapour in the furnace atmosphere thereby allowing melting and holding of liquid metal without oxidation from external and internal leaks. It also allows the escape of other unwanted low vapour pressure materials by shifting their equilibrium pressures and leaving them more free to vaporise and be removed from the clean surface by the evacuating pump.

Metallic oxides which previously would have remained either on the surface of the bath or in solution in the material may now be reduced so that the metallic portion of the oxide, being now reduced to pure metal, can be re-absorbed and dissolved in the bath so that the full alloying effect of these metals is obtained while the unwanted other constituents escape in gaseous form and are removed by the pump.

As an example of the process an inert high purity argon is introduced to the furnace chamber and the pressure reduced such that the atmosphere comprises approximately 99.99% argon and approximately 0.01% of other gaseous materials which have entered by way of leaks. This provides that the ratio of the partial pressure of the incoming leakage gaseous material to the introduced argon is about 1:1000. This atmosphere is extremely effective where no oxidising or re-carburising or reducing actions are necessary.

The process of the invention using a pressure on the surface of the bath which is preferably at least an order of magnitude lower than has been customarily known makes it possible to provide a ratio between the partial pressure of an added reactive gas and the unwanted gaseous component of the atmosphere above the surface of the metal being treated which is far greater than has been heretofore attained or has even been recognized as being desirable and this has been found to provide a much more efficient refining action on the molten metal than has heretofore been obtained and is with comparative ease able to remove unwanted components and prevent the formation of other unwanted components during the refining action. At present during metal refining actions it sometimes happens that in removing one unwanted component another unwanted component is formed although in a much smaller proportion and in that case it is more a matter of choosing the smaller of two evils.

As used herein the expression 'deleterious gas' indicates any gas which has not been deliberately introduced. It will of course be recognized by those skilled in the art that even though certain components e.g. oxygen of normal leakage gas may in some cases at certain stages of the metal refining process have a useful effect as where an oxidising stage is required, in at least some, other, cases such gases do have a deleterious effect on the refining process and the properties of the metal. The expression 'non-deleterious' gas indicates herein generally any gas which has been deliberately introduced either for the purposes of specifically reacting with the metal or simply as an inert filler gas for reducing the proportion of the deleterious gas partial pressure.

We claim:

1. A process for the refining of a body of metal having a free surface, which process comprises the steps of melting down the body of metal under substantially sub-atmospheric pressure into a pool of molten metal having a free surface and removing unwanted constituents therefrom in which process there is present an in-leakage of deleterious gas at a predetermined rate wherein the improvement comprises the further step of directing a flow of non-deleterious gas substantially directly towards said free surface of said body of metal at a rate relative to said predetermined in-leakage rate such that said body of metal is maintained under an atmosphere in which the ratio of the partial pressure of non-deleterious gas to the partial pressure of deleterious gas is at least 10:1 during said steps of melting down and removal of unwanted constituents.

2. The process of claim 1 wherein is directed towards the metal a said flow of non-deleterious gas consisting essentially of at least one of an inert gas, a reducing gas, a reducing vapor, a halogen gas, and an oxidizing gas.

3. The process of claim 2 wherein the flow of gas is directed directly at the metal with sufficient force so that when the metal is melted down to form a pool having an upper surface with a meniscus, said meniscus is depressed by said flow of gas and said gas flow spreads across said upper surface.

4. The process of claim 3 wherein the metal is maintained under a said atmosphere in which the sum of the partial pressures of all the gases is not greater than 0.1 torr.

5. An apparatus suitable for use in the process of claim 1 which apparatus comprises a vacuum induction melting furnace having a substantially sealed furnace chamber, a vessel for holding metal in said chamber, said vessel having a mouth, and gas exhaustion means disposed for extraction of gas from said chamber, wherein the improvement comprises a gas supply means formed and arranged for directing a flow of gas substantially directly at said mouth of said vessel so as to impinge directly on the metal therein in use of the apparatus.

6. The apparatus of claim 1 wherein is provided a gas flow control means disposed for controlling the flow of gas from said gas supply means so as to maintain the partial pressure of gas introduced therefrom, at a ratio to the partial pressure of other gas in said chamber of at least 10:0.

* * * * *